US005613654A

United States Patent [19]

Gellermann et al.

[11] Patent Number: 5,613,654

[45] Date of Patent: Mar. 25, 1997

[54] DEVICE FOR RELEASING THE OPENING OF THE DOORS OF RAIL VEHICLES

[75] Inventors: Wolf-Dieter Gellermann, Vechelde; Adolf Feuerhake, Braunschweig, both of Germany; Dario Comini; Guido Martinelli, both of Milan, Italy

[73] Assignee: Siemens Aktiengesellschaft, Munich, Germany

[21] Appl. No.: 569,236

[22] PCT Filed: Jul. 8, 1994

[86] PCT No.: PCT/DE94/00841

§ 371 Date: Mar. 29, 1996

§ 102(e) Date: Mar. 29, 1996

[87] PCT Pub. No.: WO95/01900

PCT Pub. Date: Jan. 19, 1995

[30] Foreign Application Priority Data

Jul. 9, 1993 [IT] Italy ..... MI93A1506

[51] Int. Cl.[6] ..... B61L 1/00

[52] U.S. Cl. ..... 246/182 B; 364/426.01

[58] Field of Search ..... 246/182 R, 182 A, 246/182 B, 182 C, 184, 209, 14; 104/27, 28, 30; 364/426.01, 426.05

[56] References Cited

U.S. PATENT DOCUMENTS

| | | | |
|---|---|---|---|
| 3,731,088 | 5/1973 | Grundy et al. | 246/182 B |
| 4,005,837 | 2/1977 | Grundy | 246/182 B |
| 4,005,838 | 2/1977 | Grundy | 246/182 B |
| 4,017,044 | 4/1977 | Anderson et al. . | |
| 4,269,377 | 5/1981 | Rush et al. | 246/182 B |
| 4,302,811 | 11/1981 | McElhenny . | |
| 4,384,695 | 5/1983 | Nohmi et al. | 246/182 B |
| 4,852,007 | 7/1989 | Yasunobu et al. | 364/426.01 |
| 5,018,689 | 5/1991 | Yasunobu et al. | 364/426.01 |

FOREIGN PATENT DOCUMENTS

| | | |
|---|---|---|
| 2401813 | 3/1979 | France . |
| 2645352 | 4/1978 | Germany . |
| 2025103 | 1/1980 | United Kingdom . |

*Primary Examiner*—Mark T. Le
*Attorney, Agent, or Firm*—Kenyon & Kenyon

[57] ABSTRACT

A device for releasing the opening of the doors of rail vehicles provides that one or more transmission devices (ZÜB1 to ZÜB4) are arranged in succession in the approach area of a train station (Bhf) to transmit signals for synchronizing the position sensing devices that are provided in passing trains (Z1, Z2). One position sensing device (3) is influenced directly and the other position sensing device (6) is influenced through an ATP device (ATP =automatic train protection) on the vehicle. The doors can be opened when the train has come to a stop and the position sensing device (3) that is influenced directly indicates that a previously announced stopping point (P1, P2) has been reached within a narrow tolerance (T1), and the other position sensing device (6) which has a broader tolerance range (T2) confirms this position. FIG. 1

12 Claims, 1 Drawing Sheet

DEVICE FOR RELEASING THE OPENING OF THE DOORS OF RAIL VEHICLES

BACKGROUND OF THE INVENTION

The present invention concerns a device for releasing the opening of the doors of rail vehicles reaching given stopping positions on platforms of railway stations.

It is known that a large portion of the operating time of rail vehicles, especially subways and streetcars, is lost in stopping at stations and mainly in the exiting and boarding of passengers, who often interfere with each other, so the amount of time required for this process is greater than the time that should actually be necessary. In order to shorten this time, it is known (from Offenlegungsschrift (OLS) U.S. Pat. No. 2,645,352) that signs marking the points of boarding and exit can be provided on the cars of the trains and along the platforms in the stations. However, the desired channeling of the streams of passengers can be implemented only if the doors of the cars can be positioned in the stations with an accuracy of a few decimeters.

British patent A 2,025,103 discloses a door control for railway cars, where the doors can be opened only when these railway cars have in fact stopped and when the front end of the train as well as the rear end of the train are in the train station. No measures for high-precision spot braking are disclosed in that patent application.

SUMMARY OF THE INVENTION

The present invention is directed to the problem of providing a device that will make the preferably automatic opening of vehicle doors of vehicles that have entered a station dependent upon very precisely reaching a previously determined stopping position.

The invention solves this problem by a device comprising at least one transmission device for intermittent train control located in an approach area of the railway station for transmitting a synchronization signal to the vehicle; a first position sensing device on the vehicle that is directly synchronized by the synchronization signal from the transmission device for intermittent train control; and a second position sensing device on the vehicle that is indirectly synchronized by the synchronization signal of the transmission device for intermittent train control. The synchronization signal is sent to the second position sensing device via a vehicle device for automatic train protection used to control the vehicle. The release of door controls depends on the direction of travel of the vehicle and on position sensing results obtained from the first position sensing device confirming the position of the vehicle at a desired predetermined stopping point within a narrow tolerance range and on position sensing results of the second position sensing device confirming this position within a broader tolerance range. Very reliable and extremely accurate automatic sensing of the position of the vehicle in the area of the station is possible through synchronization, optionally multiple synchronization, of two position sensing devices on the vehicle provided according to the teaching of the invention. This is a prerequisite for the desired spot braking of the train at very specific stopping positions.

Advantageous embodiments and refinements of this invention include the following:

If the opening of the vehicle doors is made to depend on the presence of a signal indicating that the train has come to a standstill, then this assures that the train will actually come to a stop before the doors open.

The impetus for opening the doors may come from the driver of the vehicle, or the doors may be opened by an automatic system.

Using several transmission devices for intermittent train control permits multiple synchronization of the position sensing devices. This improves the spot braking accuracy accordingly.

There may be several stopping points for stopping different trains, and the proper stopping point for a given train is determined by the length of the train.

By monitoring the distances between the transmission devices, any failure of such a transmission device can be detected.

BRIEF DESCRIPTION OF THE DRAWINGS

This invention and other advantages of this invention are explained as examples in the following detailed description of one form of a practical implementation thereof, but by no means in a restrictive sense, with reference to the accompanying figures, which show the following.

DETAILED DESCRIPTION

Figure 1:
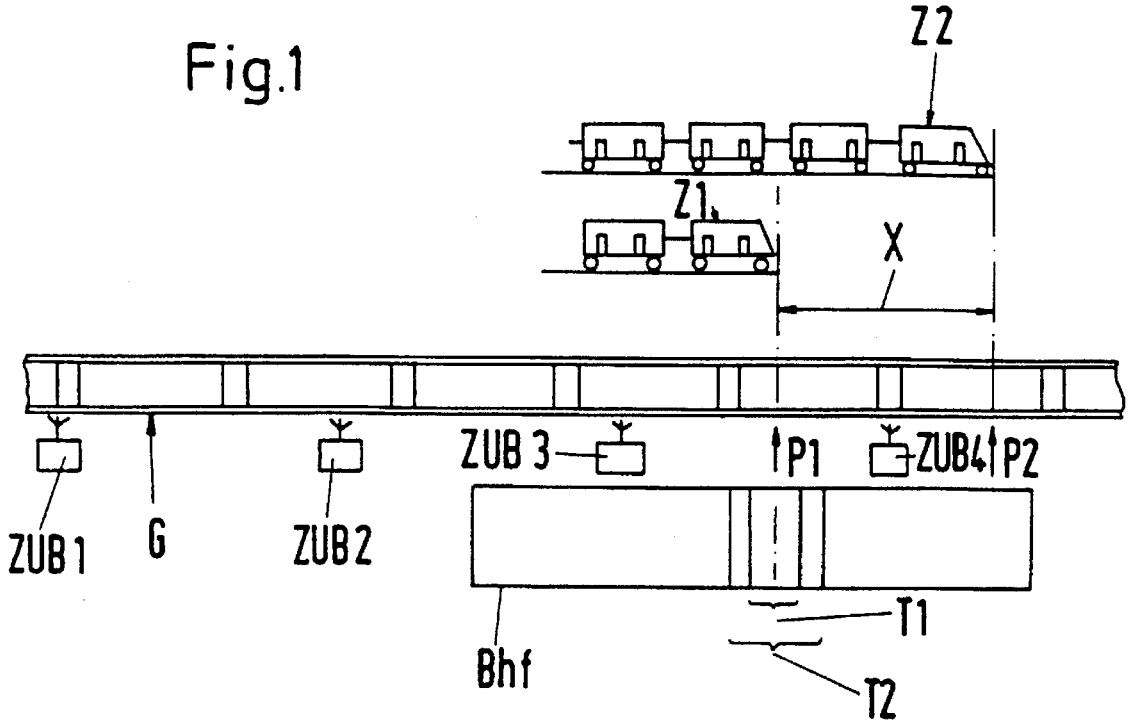
FIG. 1 shows a schematic diagram of a section of track in the area of a station.

FIG. 1 shows a section of track G in the area of a station Bhf with a platform. Trains Z1 and Z2 with differing numbers of cars are to stop in this station. The front end of the shorter train Z1 should come to a standstill at position P1, and the longer train Z2 should stop at position P2. The two stopping positions P1 and P2 are located with a distance X between them. They are selected in such a way that the doors of the cars will be positioned at very specific locations in the station, which are identified by a method that is not specified here. The trains may be understood to be streetcar or subway train systems consisting of two or four cars, for example. The trains are kept a proper distance away from each other by means of a known automatic train protection device (ATP) that is built into the individual trains but is not shown in the figures.

Several transmission devices ZÜB1, ZÜB2, ZÜB3 and ZÜB4 are arranged before station Bhf, as the train approaches said station, and in the station area along track G. The only purpose of these devices is to transmit signals to the cars or systems of cars—hereinafter referred to as trains —as they pass by, thus making it possible for the trains to determine the respective distance to the possible stopping point(s) P1 and P2. The transmission devices may communicate these distances directly to the trains. If the trains know the distances of the individual signaling devices ZÜB1 to ZÜB4 from stopping points P1 and P2, it is sufficient for transmission devices ZÜB1 to ZÜB4 to indicate to the arriving train the fact that these points have been passed as long as the train can recognize which transmission device it has traveled past.

The signals transmitted to the trains are used by the trains to synchronize the sensing devices installed in the trains themselves for determining the distance traveled. This synchronization is the prerequisite for precision stopping of the trains with their vehicle doors at the desired boarding and exit points in the stations.

Figure 2:
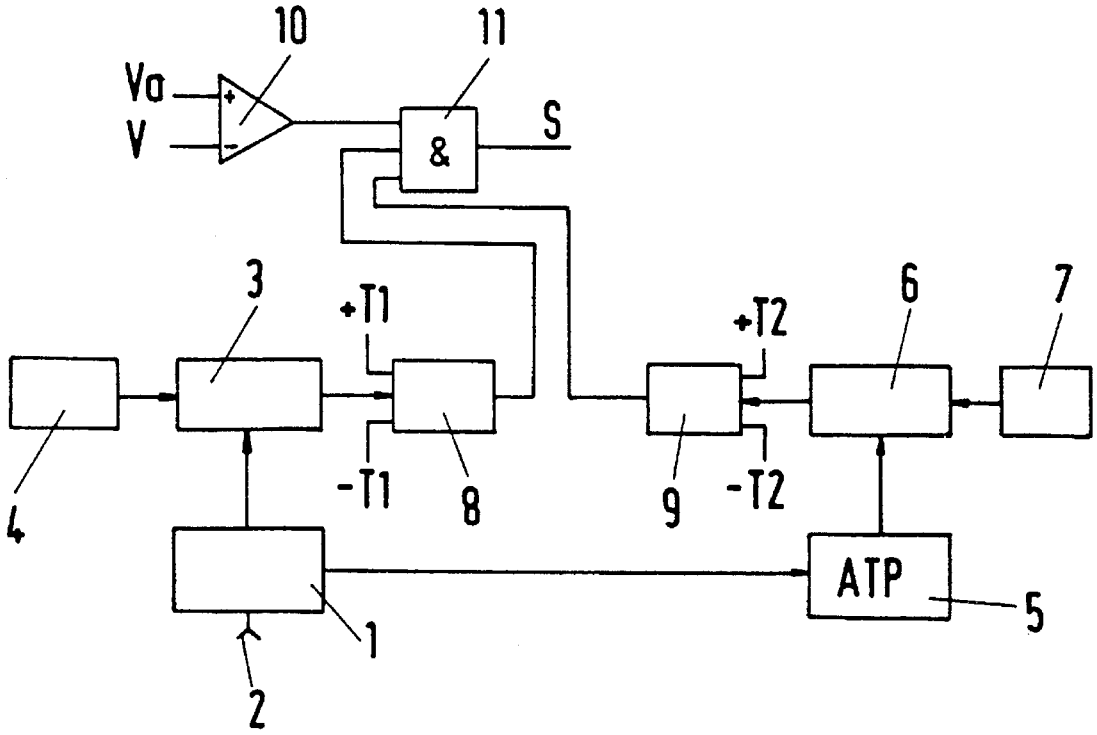
FIG. 2 shows a schematic diagram of part of the device according to this invention which is inside the vehicles of a train system.

For this purpose, part of the device according to this invention is installed in the active traction car of each train, as illustrated in a simplified diagram in FIG. 2.

As shown by the above-mentioned figure, each time the active traction car passes by one of transmission devices ZÜB1 to ZÜB4 with its receiver 1 that is installed in the car, it receives a position signal or a synchronization signal via vehicle antenna 2 and sends the signal for synchronization to a first sensing device 3 for measuring the distance traveled. This device is constantly being advanced by a position pulse generator 4 that is connected to one of the wheels of the train. The locating or synchronization signal causes position sensing device 3 to advance either to a preset starting position or to a position that corresponds to the distance between the transmission device which the train has traveled past and the desired stopping point. The length of the train determines whether the distance to stopping point P1 or to stopping point P2 must be taken into account. The synchronization signal received by the vehicle antenna is also sent to the monitoring and processing device for automatic train protection (ATP) 5 and is responsible for synchronizing a second sensing device 6 for the distance traveled, where said device is also advanced constantly by position signals generated by the same generator 4 or another generator 7.

The outputs of the two sensing devices 3 and 6 for the distance traveled are connected to analysis circuits 8 and 9 that determine whether the deviation from the nominal distance of stopping point P1 or P2 is within a tolerance that can be preset, a narrower tolerance range T1 for the output of sensing device 3 and a broader tolerance T2 for the output of sensing device 6. The two tolerance ranges T1 and T2 are illustrated in FIG. 1 for stopping point P1, and they are the same for stopping point P2, although not shown here.

The outputs of analysis circuits 8 and 9 are linked together with a comparator that compares the speed V of the train with a very low predetermined stopping speed $V_a$ in an AND circuit 11 in order to detect the presence or absence of release signal S for opening the vehicle doors.

The distance between the first transmission unit ZÜB1 and the next stopping point P1 is selected so as to permit spot braking even from the maximum allowed track speed. In principle, however, this initial signaling does not serve the purpose of precision braking. This signaling point is required in order to reduce the speed of the train to the extent that it can be stopped precisely at the proper stopping point P1 or P2 after synchronizing its sensing equipment for sensing the distance traveled from the last transmission device ZÜB3 or ZÜB4.

The diagram in FIG. 2 shows that the vehicle doors can be opened, either automatically or by the driver, when all the following conditions are met:

a) The train has stopped, in other words, the train has reached an extremely low approach speed $V_a$ or has come to a standstill.

b) The position sensing results from sensing device 3 for the distance traveled, which is influenced directly, correspond to the desired stopping point, with the narrower tolerance range T1 of 0 to 30 cm, for example, taking into account the distance between the doors and the receiving devices of the vehicle.

c) The position sensing results by the second sensing device 6 for the distance traveled confirms the result of the first sensing device 3 for the distance traveled, where the former is within the broader tolerance range T2—for example, from 0 to 2 m in comparison with the reference point. This broader tolerance range is defined by the fact that the synchronization signal of the second sensing device 6 for the distance traveled is not received directly but instead acts on sensing device 6 with a time lag merely because of the cyclic processing of the input signals.

Optionally the release of the door opening can be made to depend on the presence of a signal indicating that the train has stopped.

In order to be sure that none of the synchronization codes sent by transmission units ZÜB1 to ZÜB4 is lost, which would make it impossible for the train to stop at the predetermined point, it is expedient to verify the presence of the individual transmission units by having ATP device 5 determine from the vehicle that a synchronization signal or a code has been received within the specified length of track. For this purpose, the train must know the distance or the position of transmitting devices ZÜB1 through ZÜB4.

If the distance between the train protecting devices at all stations is always the same, these distance values can preferably be stored in the trains. However, the distance values or the position information can also be transmitted to the train via a transmission device for intermittent train control and/or a device for continuous train protection. If one of the expected synchronization signals fails to appear, an appropriate reaction such as harder braking can be deduced from this, thus assuring that accurate spot braking is still possible with subsequent synchronization at one of the following transmission devices for intermittent train control.

We claim:

1. A device for releasing door controls to enable the opening of doors of a train that comprises at least one rail vehicle, whose travel is monitored by a device for continuous train protection, on reaching a predetermined stopping position at a platform of a rail station, comprising:

at least one transmission device for intermittent train control located in an approach area of the rail station for transmitting a synchronization signal to the vehicle;

a first position sensing device on the vehicle that is directly synchronized by the synchronization signal from the at least one transmission device for intermittent train control; and a second position sensing device on the vehicle that is indirectly synchronized by the synchronization signal of the at least one transmission device for intermittent train control, wherein the synchronization signal is sent to the second position sensing device via a vehicle device for automatic train control, wherein the release of door controls is made by determining means based on the direction of travel of the vehicle and on position sensing results obtained from the first position sensing device confirming the position of the vehicle at a desired predetermined stopping point within a narrow tolerance range and on position sensing results of the second position sensing device confirming this position within a broader tolerance range.

2. The device of claim 1, wherein the release of door controls is also dependent on the presence of a signal indicating that the vehicle has come to a stop.

3. The device of claim 1, wherein the doors of the vehicle can be opened by actuating an automatic vehicle control after spot braking of the vehicle at the station platform.

4. The device of claim 1, wherein several spaced-apart transmission devices for intermittent train control are provided for transmitting signals indicating their respective distances from a predetermined stopping position, thereby enabling multiple synchronization of the first and second position sensing devices.

5. The device of claim 1, wherein a plurality of possible stopping positions exist at a station, and a proper stopping position for a given train is determined by the length of said train.

6. The device of claim 1, wherein a plurality of transmission devices for intermittent train control located within predetermined distance ranges in the approach area of the rail station are provided for synchronizing the first and second position sensing devices, said plurality of transmission devices for intermittent train control enabling distance information that is already known or that is relayed to the train from successive transmission devices for intermittent train control to be compared with the distance traveled by the train since the last synchronization.

7. A device for releasing door controls to enable the opening of doors of a train that comprises at least one vehicle, whose travel is monitored by a device for continuous train protection (ATP), on reaching a predetermined stopping position at a platform of a train station, comprising:

at least one transmission device for intermittent train control located in an approach area of the train station for transmitting a synchronization signal to the vehicle;

a first position sensing device on the vehicle that is directly synchronized by the synchronization signal from the at least one transmission device for intermittent train control; and a second position sensing device on the vehicle that is indirectly synchronized by the synchronization signal of the at least one transmission device for intermittent train control, wherein the synchronization signal is sent to the second position sensing device via the ATP device, wherein the release of door controls is made by determining means based on the direction of travel of the vehicle, whether the vehicle speed has dropped below a very low given speed, and on position sensing results obtained from the first position sensing device confirming the position of the vehicle at a desired predetermined stopping point within a narrow tolerance range, and on position sensing results of the second position sensing device confirming this position within a broader tolerance range.

8. The device of claim 7, wherein the release of door controls is also dependent on the presence of a signal indicating that the vehicle has come to a stop.

9. The device of claim 7, wherein the doors of the vehicle can be opened by actuating an automatic vehicle control after spot braking of the vehicle at the station platform.

10. The device of claim 7, wherein several spaced-apart transmission devices for intermittent train control are provided for transmitting signals indicating their respective distances from a predetermined stopping position, thereby enabling multiple synchronization of the first and second position sensing devices.

11. The device of claim 7, wherein a plurality of possible stopping positions exist at a station, and a proper stopping position for a given train is determined by the length of said train.

12. The device of claim 7, wherein a plurality of transmission devices for intermittent train control located within predetermined distance ranges in the approach area of the train station are provided for synchronizing the first and second position sensing devices, said plurality of transmission devices for intermittent train control enabling distance information that is already known or that is relayed to the train from successive transmission devices for intermittent train control to be compared with the distances traveled by the train since the last synchronization.

* * * * *